US012256816B2

(12) United States Patent
Hutton, Jr.

(10) Patent No.: US 12,256,816 B2
(45) Date of Patent: Mar. 25, 2025

(54) FOLD-OUT ACCESSORY REST FOR POLE

(71) Applicant: FHF GEAR, INC., Bozeman, MT (US)

(72) Inventor: Richard V. Hutton, Jr., Bozeman, MT (US)

( * ) Notice: Subject to any disclaimer, the term of this patent is extended or adjusted under 35 U.S.C. 154(b) by 55 days.

(21) Appl. No.: 17/955,299

(22) Filed: Sep. 28, 2022

(65) Prior Publication Data

US 2023/0096179 A1 Mar. 30, 2023

Related U.S. Application Data

(60) Provisional application No. 63/249,220, filed on Sep. 28, 2021.

(51) Int. Cl.
*A45B 1/00* (2006.01)
*A45B 5/00* (2006.01)

(52) U.S. Cl.
CPC ..... *A45B 1/00* (2013.01); *A45B 5/00* (2013.01); *A45B 2200/055* (2013.01)

(58) Field of Classification Search
CPC ..... A45B 5/00; A45B 1/00; A61H 2003/002
See application file for complete search history.

(56) References Cited

U.S. PATENT DOCUMENTS 768,882 A * 8/1904 Morse ..... A45B 5/00 297/118
2,495,889 A * 1/1950 Connaghan ..... A61H 3/02 248/235
2,553,730 A * 5/1951 Wyndon ..... A61H 3/00 135/66
4,910,927 A * 3/1990 Beatty ..... A61H 3/02 182/120
5,410,835 A 5/1995 Vetter
5,723,808 A 3/1998 Devall
6,035,572 A 3/2000 Goode, Jr.
6,526,687 B1 3/2003 Looney
6,931,782 B1 8/2005 Pitcock
6,935,065 B1 8/2005 Oliver
6,951,072 B2 10/2005 Schurtenberger
8,215,325 B2 * 7/2012 Montanti ..... A61H 3/00 135/65
8,549,786 B1 10/2013 Griffith
(Continued)

FOREIGN PATENT DOCUMENTS

DE 335384 C * 4/1921

OTHER PUBLICATIONS

Machine Translation of DE 335384 (Year: 1921).*

*Primary Examiner* — Noah Chandler Hawk
(74) *Attorney, Agent, or Firm* — Pedersen and Company, PLLC; Ken J. Pedersen; Barbara S. Pedersen

(57) ABSTRACT

A fold-out accessory rest is for securement to a trekking or ski pole or tripod leg in a folded-up position and then easily deployed by unfolding the rest for supporting a firearm, scope, camera, or other accessory. The rest includes a rest body for mounting on a pole/leg, a strap-supporting flap rotatably connected at its lower end near a lower part of the rest body, and a rest-strap rotatably connected at a proximal end near the rest-body's middle part and at a distal end to the distal end of the strap-supporting flap. When the rest-body is deployed in its folded-out position, a firearm barrel or forestock or camera telephoto lens or other accessory may be laid upon the rest-body to steady the accessory for use.

16 Claims, 16 Drawing Sheets

(56) References Cited

U.S. PATENT DOCUMENTS

| | | | | |
|---|---|---|---|---|
| 8,813,407 | B1 | 8/2014 | Sargent et al. | |
| 9,097,481 | B2 | 8/2015 | Chaney | |
| 9,151,562 | B1 | 10/2015 | Pugliese | |
| 11,339,916 | B2 | 5/2022 | Smith | |
| 2005/0005500 | A1 | 1/2005 | Howley | |
| 2015/0335110 | A1* | 11/2015 | Holmes | A45B 5/00 135/66 |
| 2018/0035769 | A1* | 2/2018 | Wilber | A45B 3/10 |

* cited by examiner

FOLD-OUT ACCESSORY REST FOR POLE

This non-provisional application claims priority of Provisional Application Ser. No. 63/249,220, filed Sep. 28, 2022, the entire disclosure of which is incorporated herein by this reference.

BACKGROUND OF THE DISCLOSED TECHNOLOGY

Field of the Disclosed Technology

This invention relates primarily to outdoor recreation, like hiking, hunting and wilderness photography. Other fields of use may also exist. Of particular relevance are hiking with trekking poles, skiing with poles, hunting with shooting sticks, and outdoor photography with tripods, for example. Preferably, the field is hunting with firearms, and with shooting sticks, trekking or ski poles and/or tripods for mounting spotting optics, firearms or cameras.

Related Art

U.S. Patent Application Publication #US2005/0005500 (Howley) discloses a fishing rod rest for securement to a cylindrical boat rail.

U.S. Pat. No. 6,951,072 (Schurtenberger) discloses a foldout gun-rest hook connected to a split-ring gun barrel bracket.

U.S. Pat. No. 8,813,407 (Sargent, et al.) discloses a rigid firearm rest with a hook-shaped connection to a pole or leg.

U.S. Pat. No. 9,097,481 (Chaney) discloses a gun-rest of two stanchions pivotally and detachably connected to respective legs of a gun-rest tripod.

Still, there is a need in outdoor recreation for a lightweight, simple fold-out accessory rest conveniently attachable onto trekking and ski poles, shooting sticks and/or tripods. This way, the rest may easily support a camera, a firearm or a spotting scope/telescope/bin- or mon-oculars, for example. The object of this disclosed technology is to address that need.

SUMMARY OF THE DISCLOSED TECHNOLOGY

The disclosed technology comprises, in different embodiments, a means for securing a fold-out accessory rest to a pole or tripod leg, for example. The securement means may be, for example in one preferred embodiment, an array of hook-and-loop type straps extending generally perpendicularly to the long axis of an elongated rest body with top, middle and lower parts. The rest body typically has a rest receiving and securing structure near its top part for securely storing the rest in its stowed folded-up (un-deployed) position. Also, the rest body has a rest-strap rotatably attached on the rest-strap's proximal end near the rest's middle part, the rest-strap also being foldably connected at the juncture of its distal end to the distal end of a strap-supporting flap, which supporting flap is also rotatably attached on its proximal end, but to a lower part of the rest body.

To install the subject fold-out rest body on a leg or pole, one secures it to about the middle of a shooting stick or tripod leg, or trekking pole or ski-pole. The exact location of the rest body on the leg or pole is optional subject to the preference of the user. Then, to deploy the subject fold-out rest, one undoes the rest receiving and securing structure near the top of the rest-body to release and unfold/rotate outwardly (deploy) the distal ends of both the rest-strap and the strap-supporting flap, which ends are mutually foldably connected to form a flexible juncture thereof. Then, a firearm barrel or forestock or camera telephoto lens or other accessory may be laid upon the deployed rest-strap, supported by the supporting flap, to steady the laid-upon accessory for use.

Certain embodiments of the fold-out accessory rest, in a deployed position, may be described as the rest-body, the rest-strap, and the supporting flap forming a triangle, wherein the rest-strap is the upper leg of the triangle and flexes to cradle a firearm barrel or forestock, a camera telephoto lens, or other accessory. In certain embodiments, the rest body is rigid or somewhat rigid or made rigid in effect by being mounted to the rigid pole/leg, the rest-strap is flexible, and the supporting-flap is more rigid than the rest-strap, with the rest-strap being pivotally/flexibly connected on its proximal end between the rest-body near its upper part, and the supporting-flap at the supporting-flap's distal end to create a flexible "bridge" between the rest body and supporting-flap for receiving and cradling and steadying the firearm barrel or forestock, a camera telephoto lens, or other accessory. In certain embodiments, the rest body bends or flexes in a direction transverse to its length to take the form of the outer circumference of the pole/leg on which it is mounted, for example, due to the mounting straps being tightened around at least portions of the rest body and around the pole/leg. In certain embodiments, the rest body is formed with a transversely curved inner surface next to the pole/leg to simulate or match the curvature of the pole/leg. Said mounting of the rest body to a rigid pole/leg and the more rigid supporting flap together form two arms between which the rest-strap hangs somewhat freely so that a firearm barrel or forestock, a camera telephoto lens, or other accessory can be received and supported by the "span" of the rest-strap.

DETAILED DESCRIPTION OF CERTAIN EMBODIMENTS

Referring to the Figures, there are shown several but not all embodiments of a fold-out accessory rest for use on a tripod, bi-pod, shooting stick, trekking stick, or other device comprising at least one pole/leg.

Figure 1:
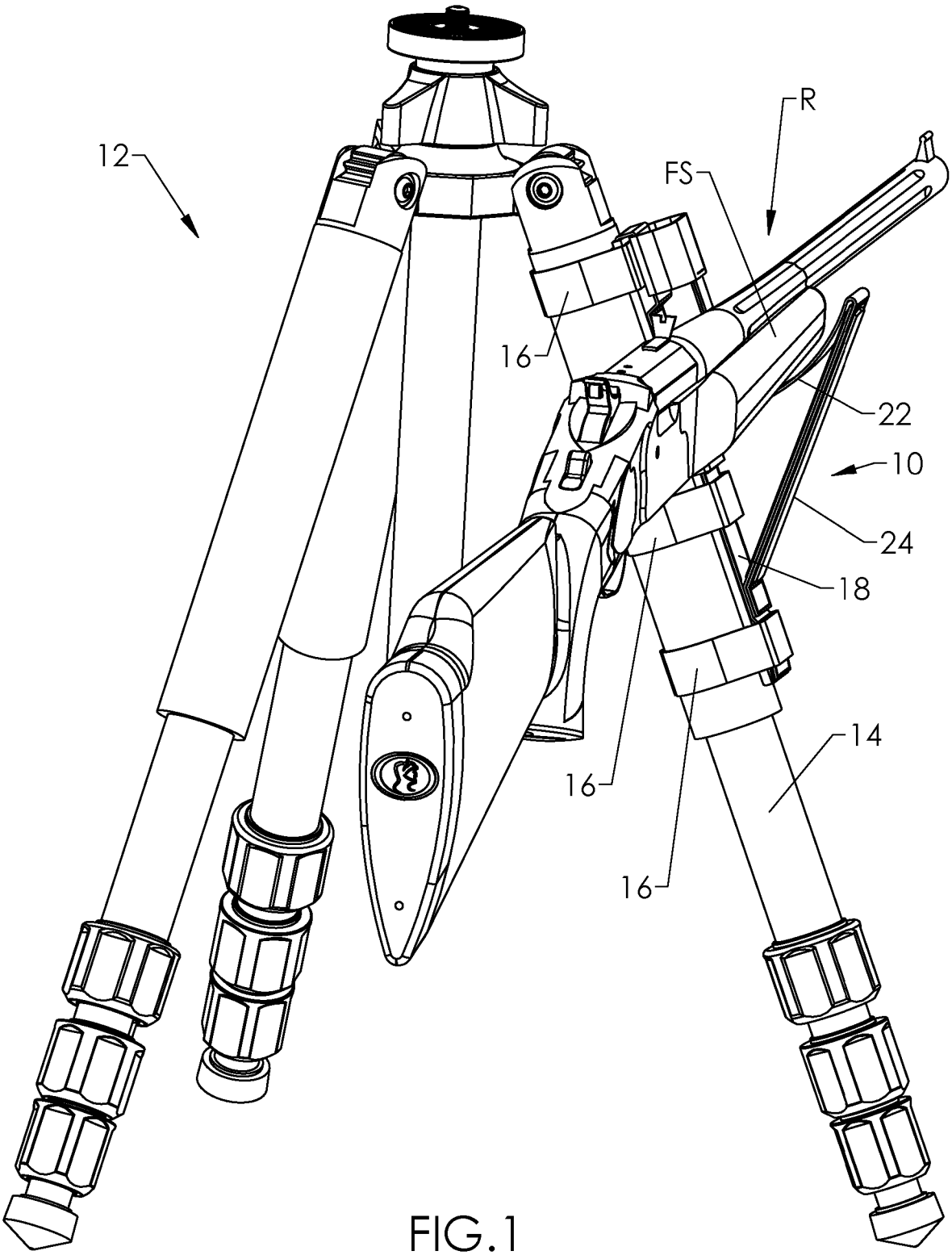
FIG. 1 is a right rear side perspective side view of one mostly fabric embodiment of the subject fold-out accessory rest installed on a tripod leg with three integral mounting straps, in the deployed position wherein the rest is supporting the forestock of a rifle. It may be noted that in FIG. 1, and in all the figures, that the terms front, rear, right, left, top and bottom are exemplary and are from the perspective of a user of the rest, wherein the rest is installed to extend rightward from a right pole/leg in front of the user, for example a right-handed shooter who will place a firearm on the rest and face forward toward the rest during shooting. Other uses and orientations may apply, for example, if the shooter is a left-handed shooter who will install the rest on a left leg of a tri-pod so that it extends to the left, wherein the user will place a firearm on the rest and face forward toward the rest during shooting.
Figure 2:
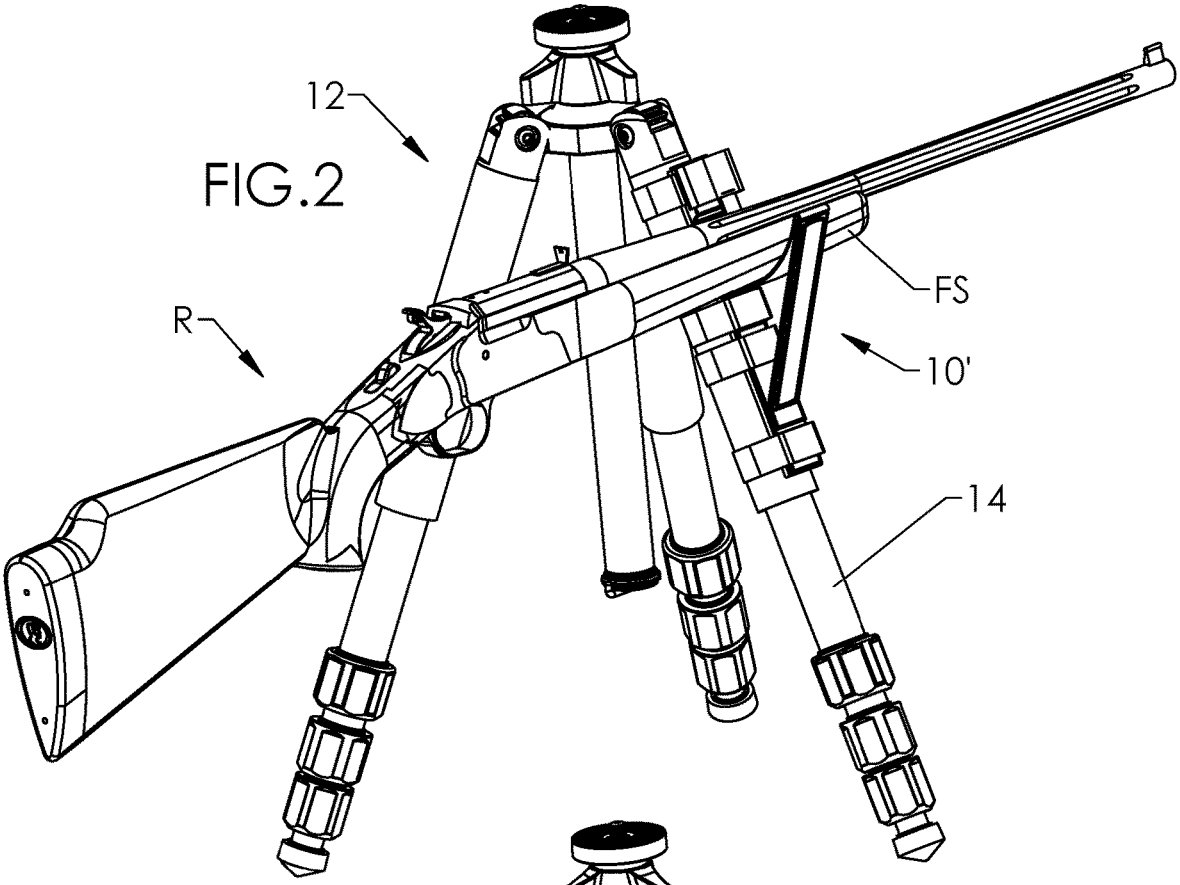
FIG. 2 is a top right rear perspective view of an alternative embodiment of the fold-out accessory rest installed on a tripod leg with the three integral mounting straps and with one visible additional mounting strap.

Depicted in FIG. 1 is a right rear side perspective view of one mostly soft-goods embodiment, specifically a mostly fabric embodiment of a fold-out accessory rest 10. The rest 10 is installed on a tripod 12 leg 14 and is supporting the forestock FS of a rifle R for stabilizing the rifle during aiming and shooting. It will be understood that the shooter will grasp and use the rifle in conventional manner but with the stabilization assistance provided by the rest 10 supporting the forestock. Accessory rest 10 is secured to leg 14, as shown in FIG. 1, by three hook-and-loop fastener straps 16 that are connected to the rest body 18 and are wrapped and fastened around the leg 14. In certain embodiments, the top, middle and bottom fastener straps 16 are sewn or otherwise permanently attached to the rest body 18, for example at one end of each strap 16, so they are always easily available for mounting the rest 10 to a pole/leg. Therefore, these three mounting straps 16 may be called an embodiment of integral mounting straps. Each fastener strap 16 is preferably a hook-and-look fastener, wherein both hook and loop portions are provided on each individual strap 16 so that the hook portion that attaches to the loop portion of the same strap, as is known in some currently-available hook-and-loop fasteners such as those called VELCRO™ ONE-WRAP.

The rest 10' of FIG. 2-5 is the same or substantially the same as the rest 10 in FIG. 1, except that additional, optional fastener straps 16' are used to increase reliability of the mounting to a pole/leg, especially helping to prevent sliding of the rest 10' down the pole/leg. The additional hook-and-loop fastener straps 16' are wrapped and fastened around portions of the rest-body 18 and the leg 14. These straps 16' may be considered non-integral straps that are separate from, or easily removable from, the rest body 18, for use when additional securement is desired.

Figure 3:
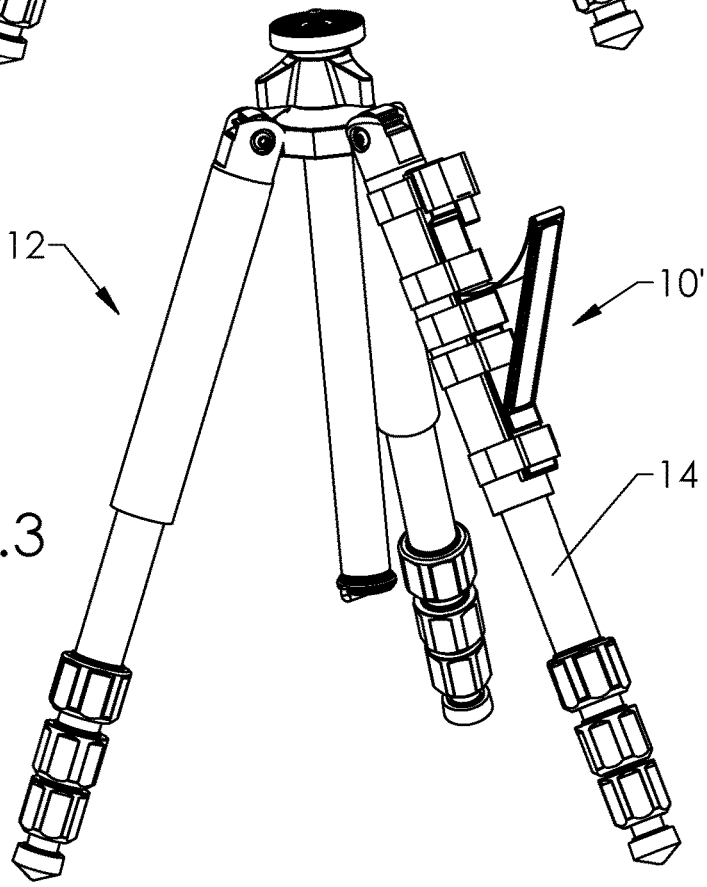
FIG. 3 is the same view of the embodiment of FIG. 2, with the rifle removed from the rest, showing two additional mounting straps.
Figure 4:
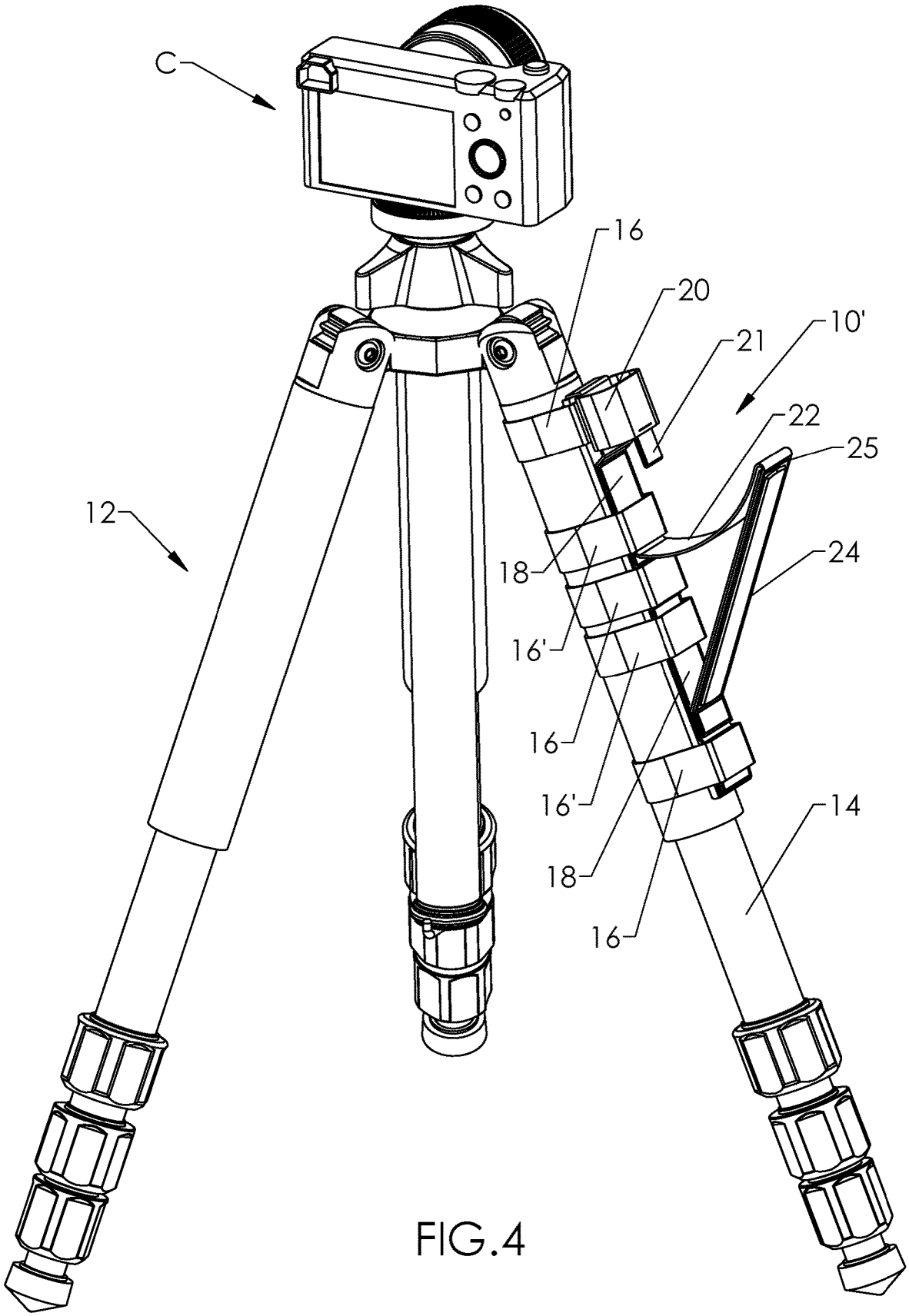
FIG. 4 is right rear perspective view of the embodiment of FIG. 2, with the rifle removed from the rest and with a camera installed at the top of the tripod.

As depicted in FIGS. 3 and 4, wherein the rifle R has been removed, the folded-out accessory rest 10' is seen to comprise the rest body 18 that lies against leg 14 and is fastened to the leg 14 by fastener straps 16, 16', a receiving and securing structure 20 with pull tab 21 at or near rest-body's 18 top part, a rest-strap 22 that extends between an approximately-mid point of the body 18 and the juncture 25 with the outer (distal) end of a strap-supporting flap 24. In the deployed position of the rest 10' of FIGS. 3 and 4, one may see that the proximal end of the rest-strap 22 is lower than the distal end of the rest-strap 22.

It may be noted that, in the deployed position, as in FIGS. 1-4, the fold-out accessory rests 10, 10' form a triangular structure, wherein the rest body 18 and the strap-supporting flap 24 form a V-shape, wherein the rest body's 18 rigidity and/or securement to a rigid pole/leg 14 and the strap-supporting flap's rigidity provide rigid or substantially-rigid upwardly-extending arms for supporting the rest-strap 22. The rest-strap 22 is suspended between the rest-body 18 and the strap-supporting flap 24, and is therefore well-positioned to flexibly receive and cradle an object placed on top of the rest-strap 22. Typically, the object will be elongated at least to some extent, with the user holding a rear-end and/or a front-end of the object that is additionally supported by the rest 10, 10'. Alternatively, the user may hold a portion of the object cradled by the rest-strap 22, including if the object is not significantly elongated. FIG. 4 illustrates a camera C connected to the tripod 12, illustrating that the pole/leg 14 to which the rest 10' is connected may be used for other/additional purposes.

It may be understood from FIGS. 1-4, which portray the rest 10, 10' in the folded-out, unsecured (deployed) position, that rest-strap 22 extends rotatably foldably outwardly and generally perpendicularly at strap 22's proximal end connection from near the middle part of rest body 18, out to its flexible juncture 25 at the distal end of supporting flap 24. In turn, strap-supporting flap 24 extends rotatably foldably outwardly and up at an angle from flap 24's proximal end connection near the bottom part of rest body 18, out to the juncture 25 at the distal end of rest-strap 22.

It may be noted that the terms rotatably, flexibly, and/or pivotally may be used to describe certain embodiments of the rest-strap, with a fabric/webbing strap being a preferred embodiment that may be described as rotatable and/or pivotal at its proximal and distal connections, and flexible all along its length so that it can take the desired cradle form to support an accessory, but also fold between the rest body 18 and the supporting flap 24.

Figure 5:
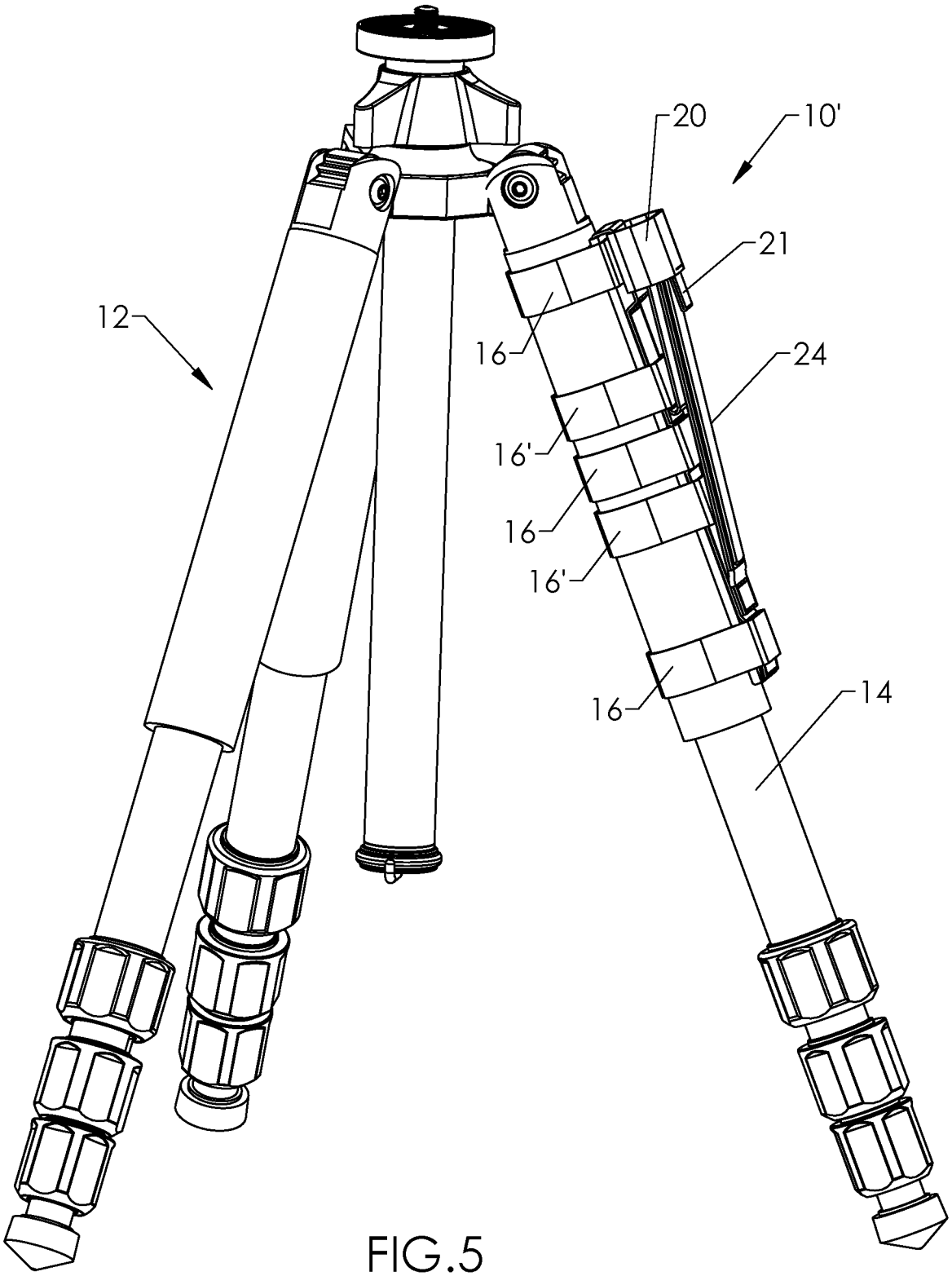
FIG. 5 is a right rear perspective view of the embodiment of FIG. 1, with the rifle removed and with the rest in the folded-up (undeployed) and stored position.

Also, it will be understood by comparing the deployed rest 10, 10' position of FIGS. 1-4 to the undeployed rest 10' position in FIG. 5, that the rest 10, 10' may be folded to place the rest-strap 22 and supporting flap 24 against the rest body 18 for storage, for example for easy carrying in the outdoors to another location for continued hunting or photography. This folding action moves the supporting flap 24 toward rest body 18, folding the rest-strap 22 between the supporting flap 24 and the rest body 18, and allows the elastic-loop-based storage structure 20 to be pulled around the juncture 25 at the distal end of supporting flap 24, typically by pulling on tab 21. This folding of the supporting flap 24 to the rest body 18, with the rest-strap 22 between the supporting flap 24 and rest body 18, results in the rest 10 being in a thin, compact shape substantially flat against the pole/leg 14, wherein the rest body 18 and supporting flap 24 are parallel to the pole/leg 14 and all the pieces/parts of rest 10, 10' are close to the pole/leg 14 on which the rest body 18 is mounted. In the undeployed/stowed position in FIG. 5 (and in FIGS. 9, 10, 11, and 17), one may see that the proximal end of the rest-strap 22, 222 is lower than the distal end of the rest-strap 22, 222. Then, when the rest 10, 10' is needed again, the supporting flap 24 may be quickly and conveniently un-secured from storage structure 20 by pull tab 21 and unfolded to become deployed so that rest-strap 22 and supporting flap 24, both extending outwardly a distance from the rest body 18, are mutually flexibly connected at the juncture 25 at the mutual distal ends of the rest-strap 22 and the supporting flap 24, ready to receive, support and stabilize a firearm barrel or forestock, or a telephoto camera lens, for example.

The convenient transition between undeployed and deployed positions of the rest 10, 10' allows the rest to be mounted to a pole/leg 14 in a convenient location, for example at the user's vehicle or camp-site, carried in the stored position to the field, unfolded out easily and quietly for use for recreation or hunting, and then folded back up again easily and quietly so that the rest 10, 10' may be carried again on the pole/leg 14 without the rest-strap 22 or supporting flap 24 extending any significant distance out from the body. This way, during carrying, the rest 10, 10' is unlikely to snag/catch on brush, limbs, clothing, or fits more easily in a bag or tote.

Figure 6:
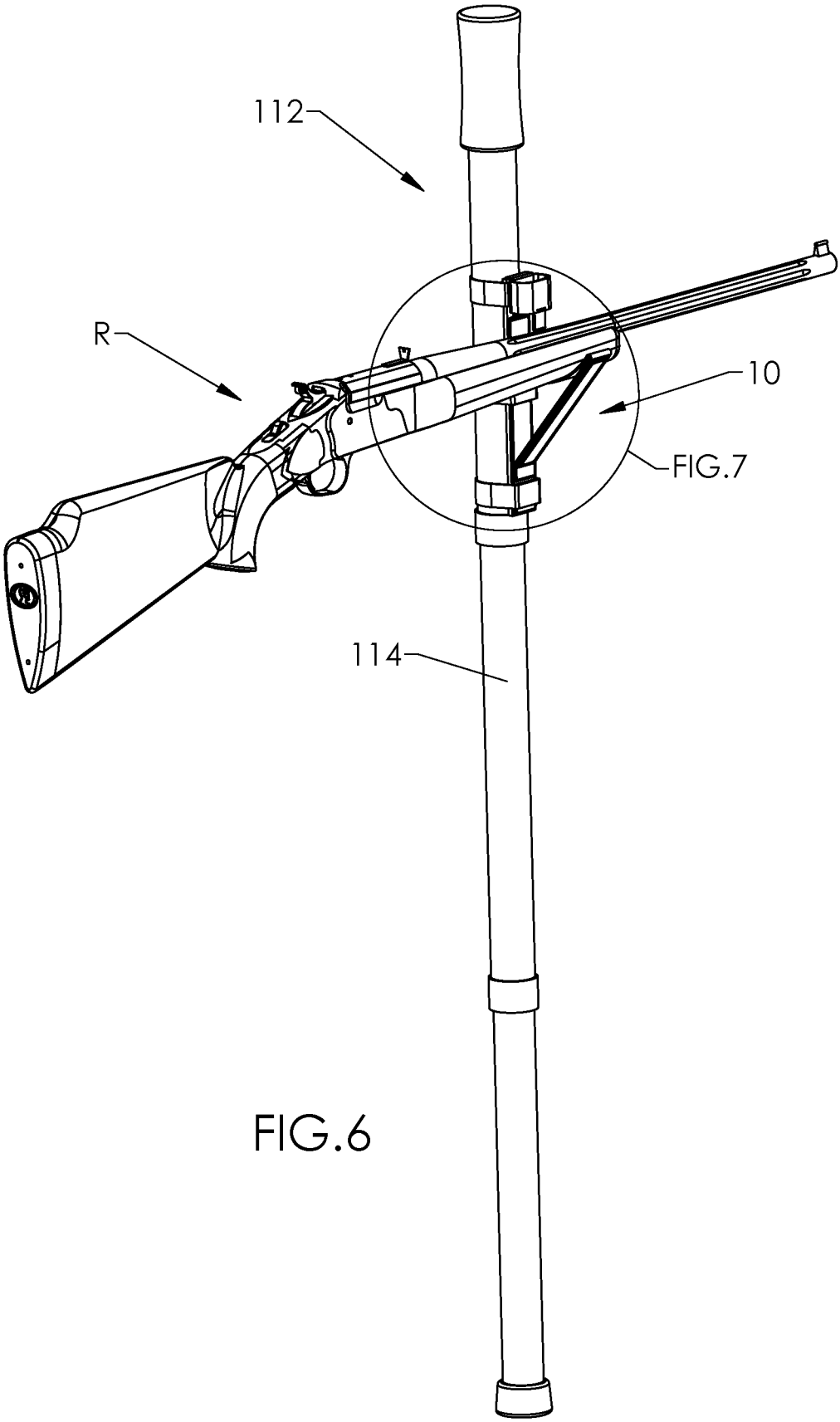
FIG. 6 is a right rear perspective view of the fold-out accessory rest of FIG. 1 installed on a trekking pole and deployed to hold a rifle.
Figure 7:
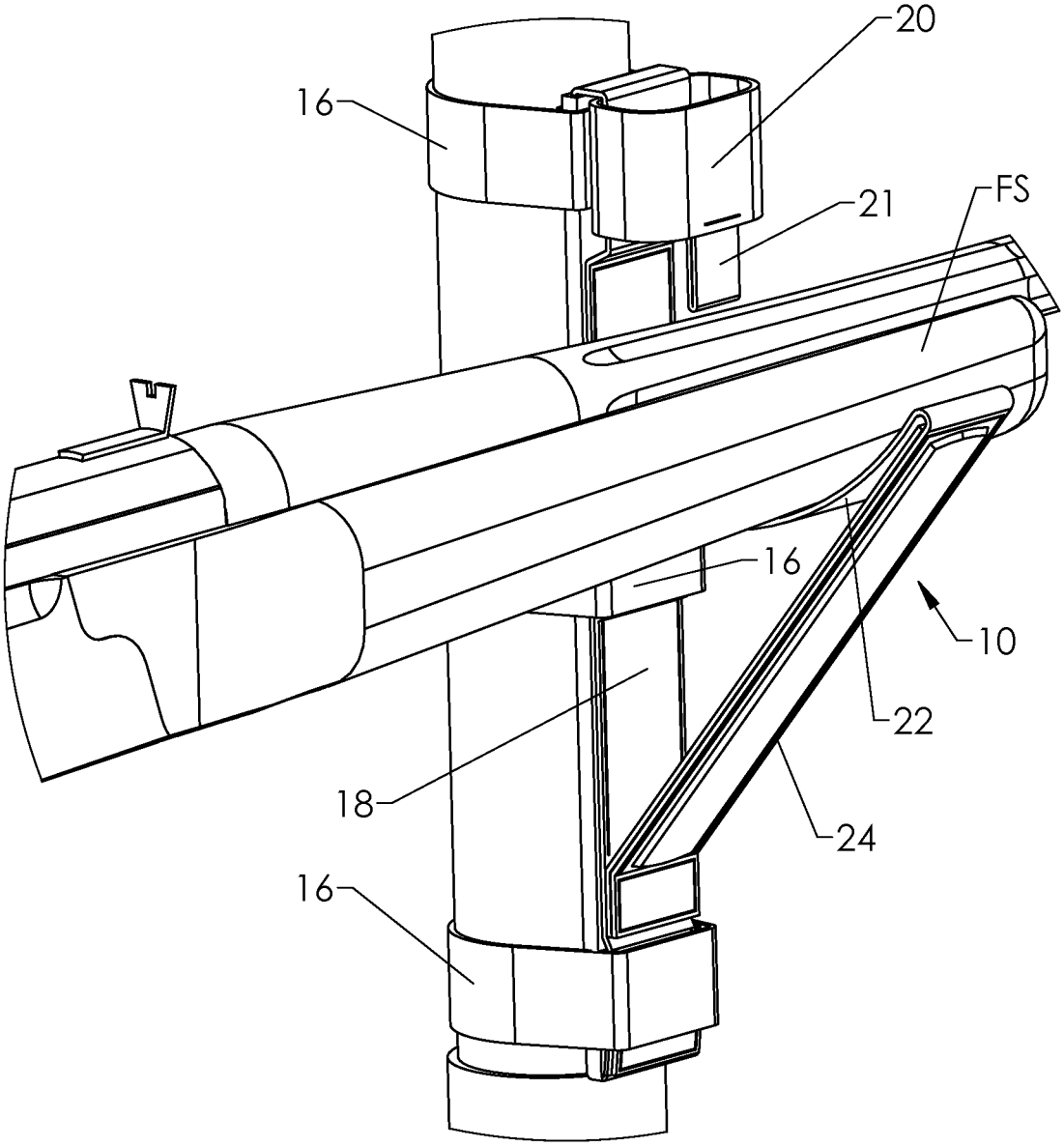
FIG. 7 is an enlargement of the detail circled in FIG. 6.
Figure 8:
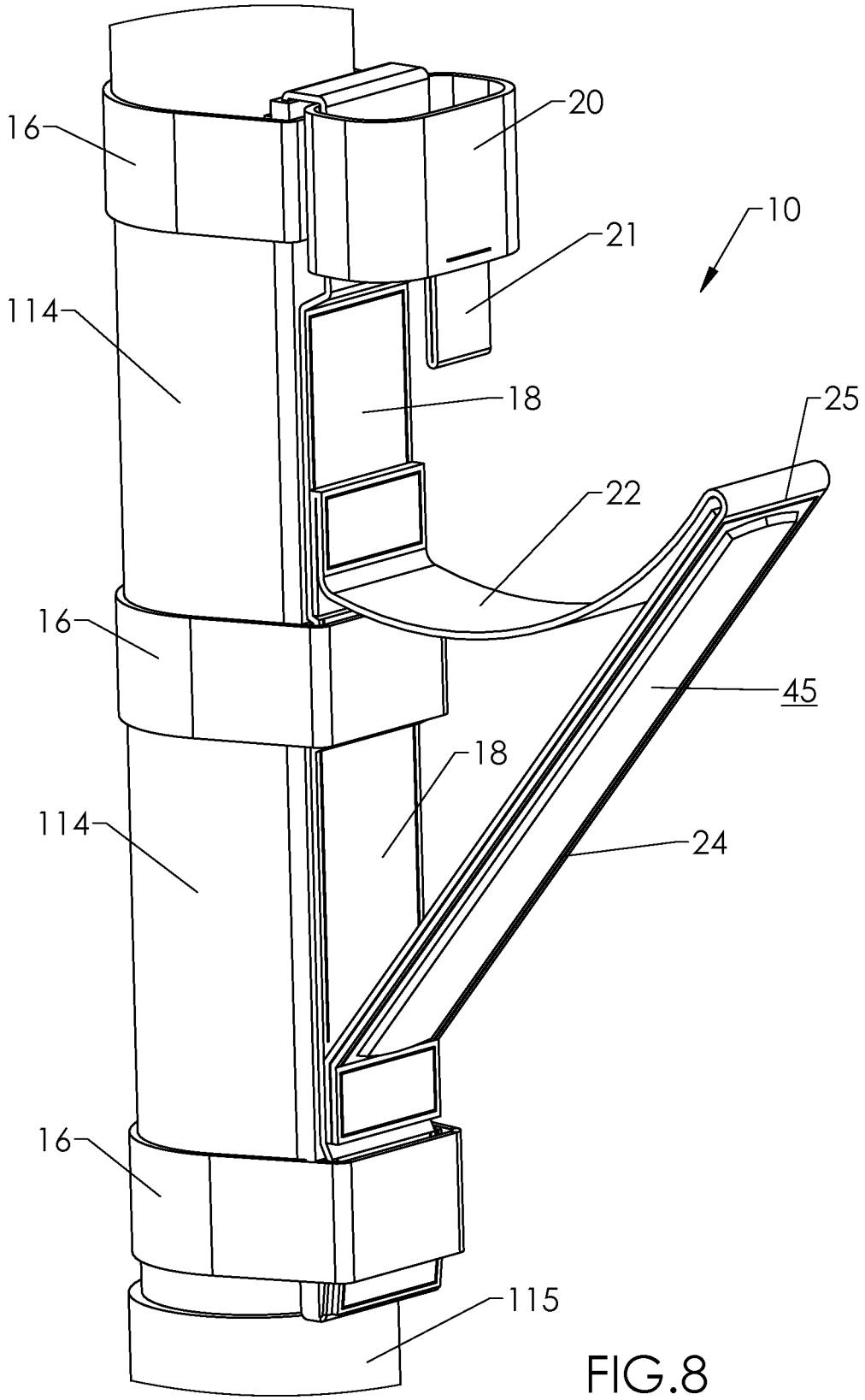
FIG. 8 is a further enlargement, compared to FIG. 7, of the detail circled in FIG. 6, with the rifle removed from the rest.
Figure 9:
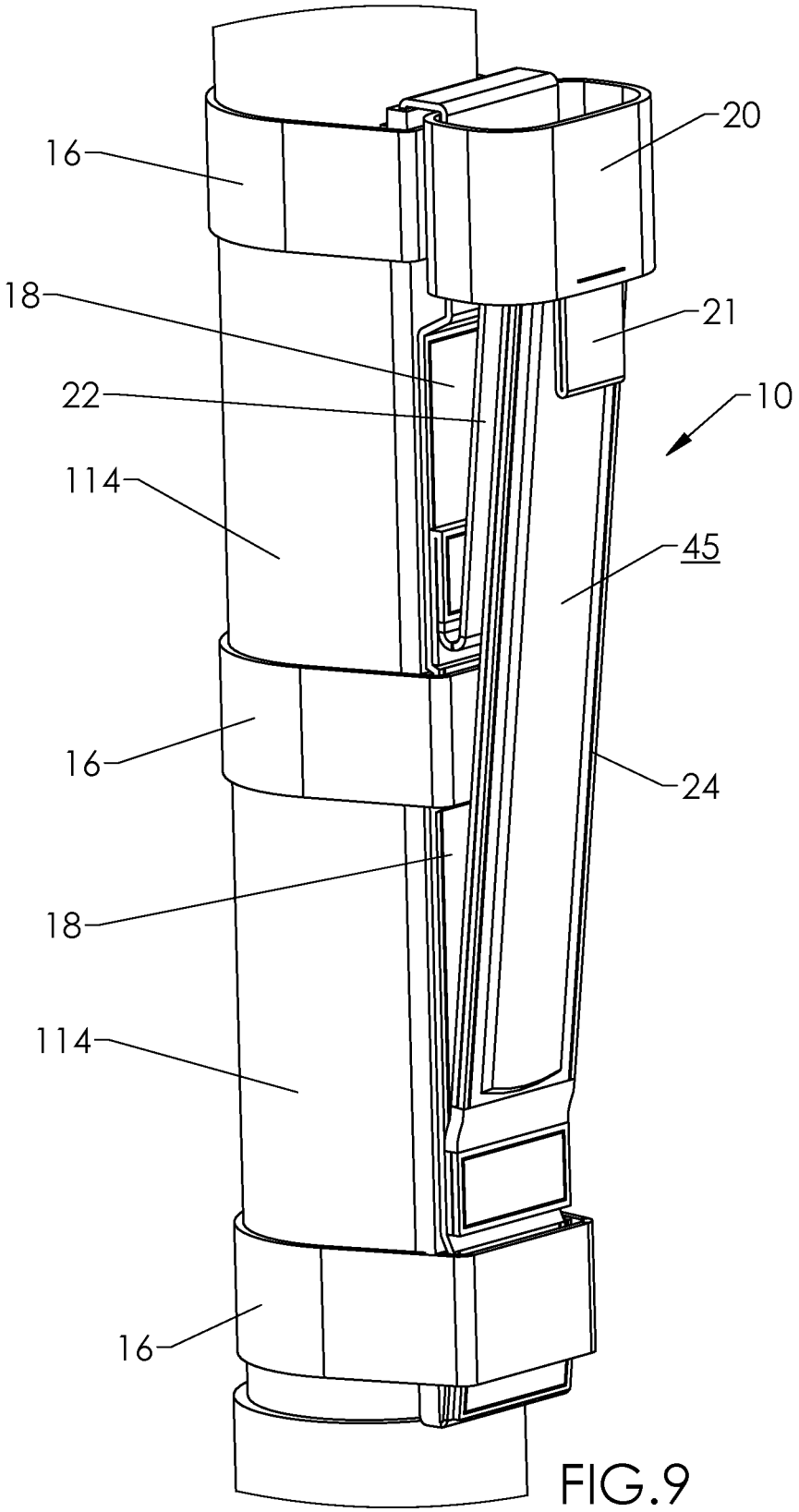
FIG. 9 is an enlargement of the detail circled in FIG. 6, as in FIG. 8, with the rifle removed from the rest, and the rest in a folded-up (undeployed) position.

As depicted in FIGS. 6-9, rest 10 is secured to the single pole/leg 114 of trekking stick 112. Rest 10 is secured by three fastener straps 16, but not the additional straps 16', for example, due to the user being able to tighten the straps 16 very tightly on the pole/leg 114, and/or rest 10 being above a telescoping ring-flange 115 of pole/leg 114, which may further prevent sliding of the rest 10 down the pole/leg 114. FIGS. 6 and 7 depict rest 10 deployed and in use supporting the forestock FS of a rifle R. FIG. 8 depicts rest 10 deployed but with the rifle removed. FIG. 9 depicts rest 10 in its folded, undeployed position, with the juncture 25 at the distal ends of the rest-strap 22 and the supporting flap 24 captured by elastic-loop storage structure 20.

A user may hold the stick 112 in a vertical position by wrapping a first hand around the stick 112 near its upper end. That first hand may also wrap around a portion of the object being supported by the rest 10, for example, by the user wrapping the hand around the pole/leg 114 at the location of the rest 10 and also extending his/her fingers around part of the rifle at the forestock. This way, the rifle is stabilized, and the user may accurately shoot the rifle even though only a single pole/leg is being used. If the stick upon which the rest is installed has a sharp/pointed bottom end, for example a shooting stick, the user may push the stick a few inches into the ground, or snow, if present, as well as holding the stick and/or the object supported by the rest.

Figure 10:
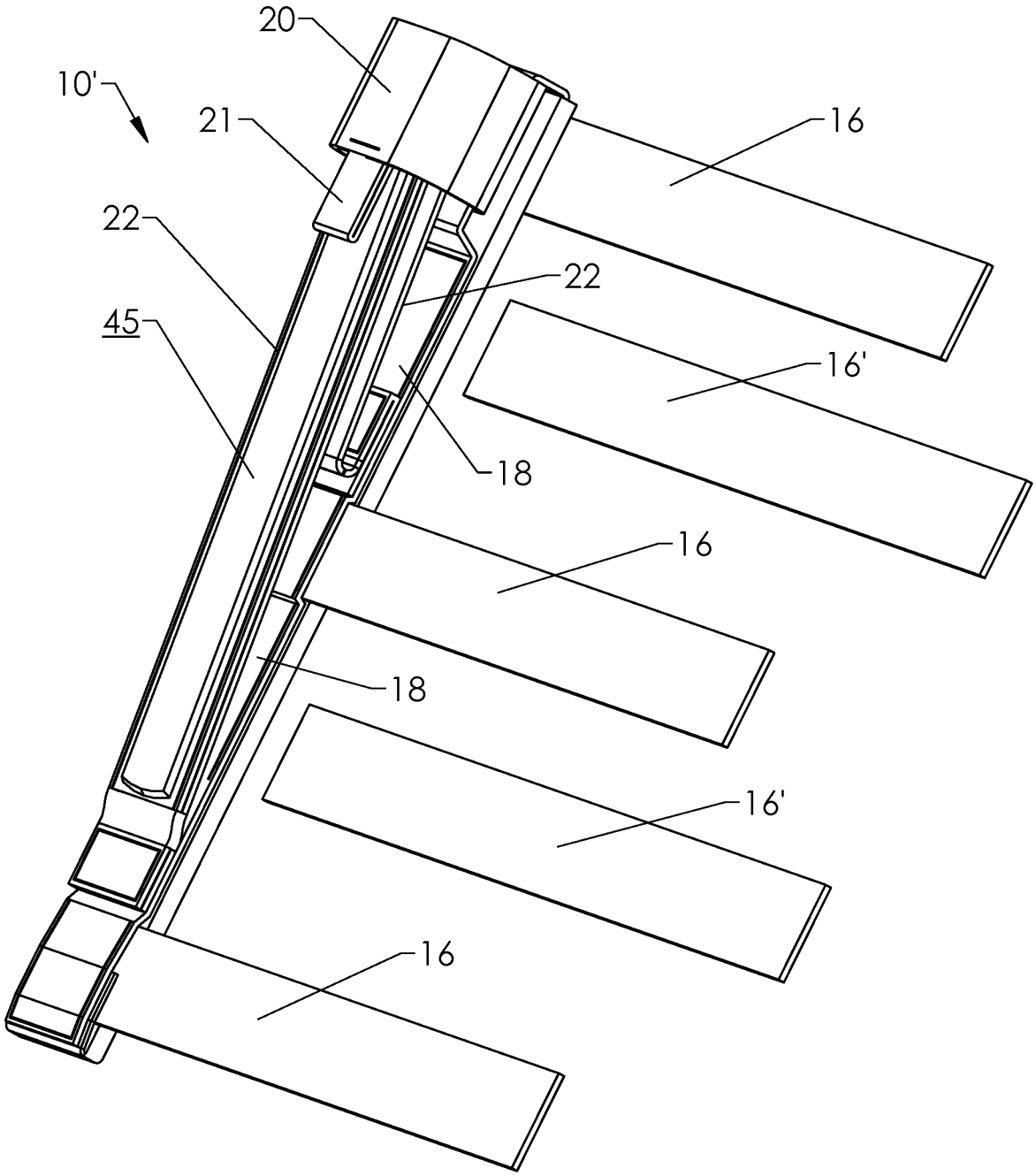
FIG. 10 is front right perspective view of the fold-out accessory rest embodiment of FIGS. 2-5, wherein the rest is removed from the tripod, the rest is in the folded-up (undeployed) position, the top, middle and bottom mounting straps are unfastened to extend from the rest body to the right, and the second and fourth straps are unfastened and detached from the rest body. It may be noted that this embodiment when mounted to a pole/leg with only the top, middle and bottom straps, is the same as or very similar to the embodiment of FIGS. 1 and 6-9.
Figure 11:
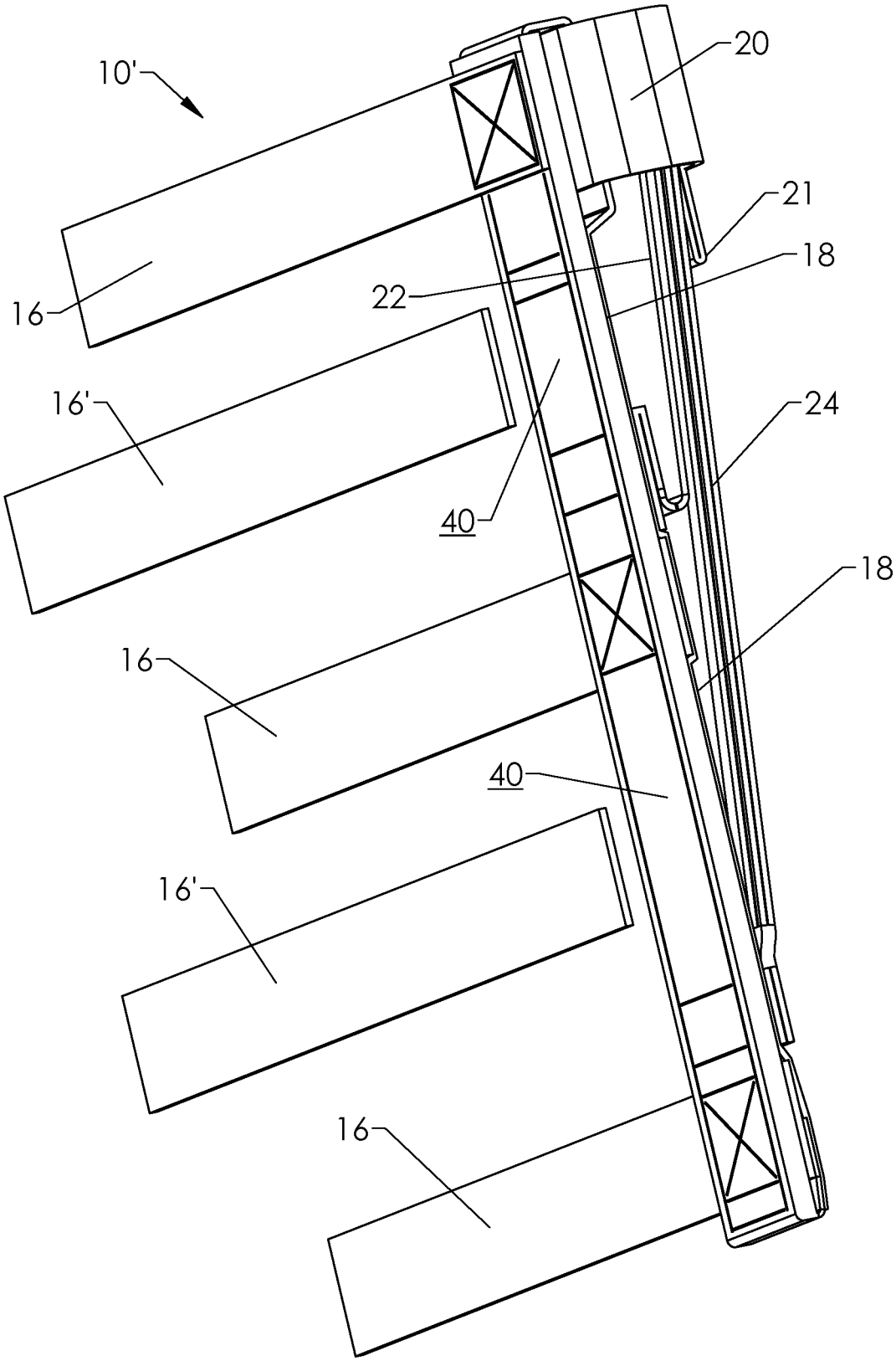
FIG. 11 is rear left perspective view of the rest embodiment that is laid out as portrayed in FIG. 10.

FIGS. 10 and 11 depict the folded/stored (undeployed) rest 10' detached from any pole/leg, and with the three hook-and-loop fastener straps 16 being unfastened, un-wrapped, and fully extended perpendicularly from the side of rest body 10'. Also, the added hook-and-hoop straps 16' are unfastened, un-wrapped (and in doing go, separated from the rest-body 18) and set to the side.

Figure 12:
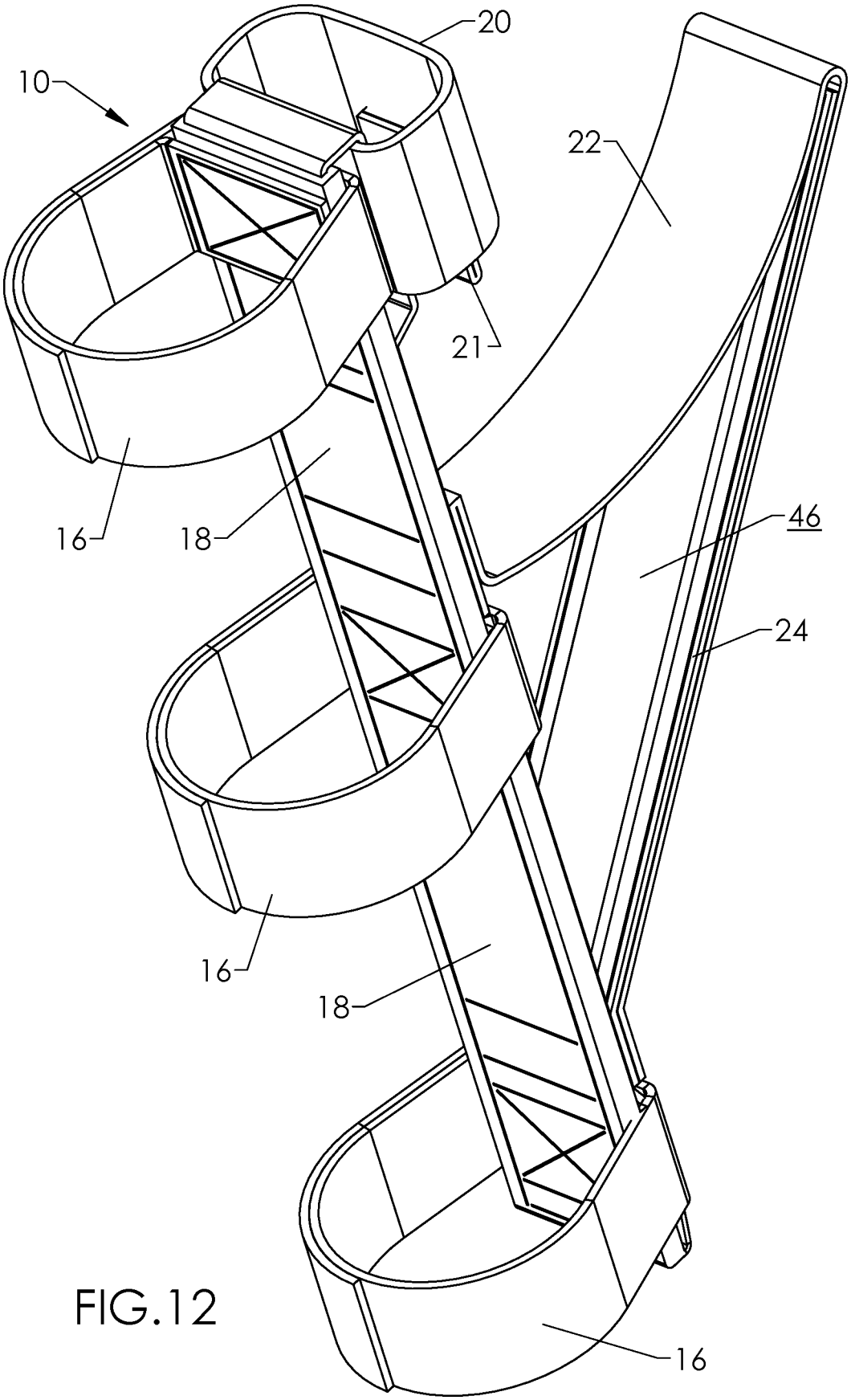
FIG. 12 is a top rear perspective view of the embodiment of FIGS. 1, and 6-9, with top, middle and bottom mounting straps fastened into loops.
Figure 13:
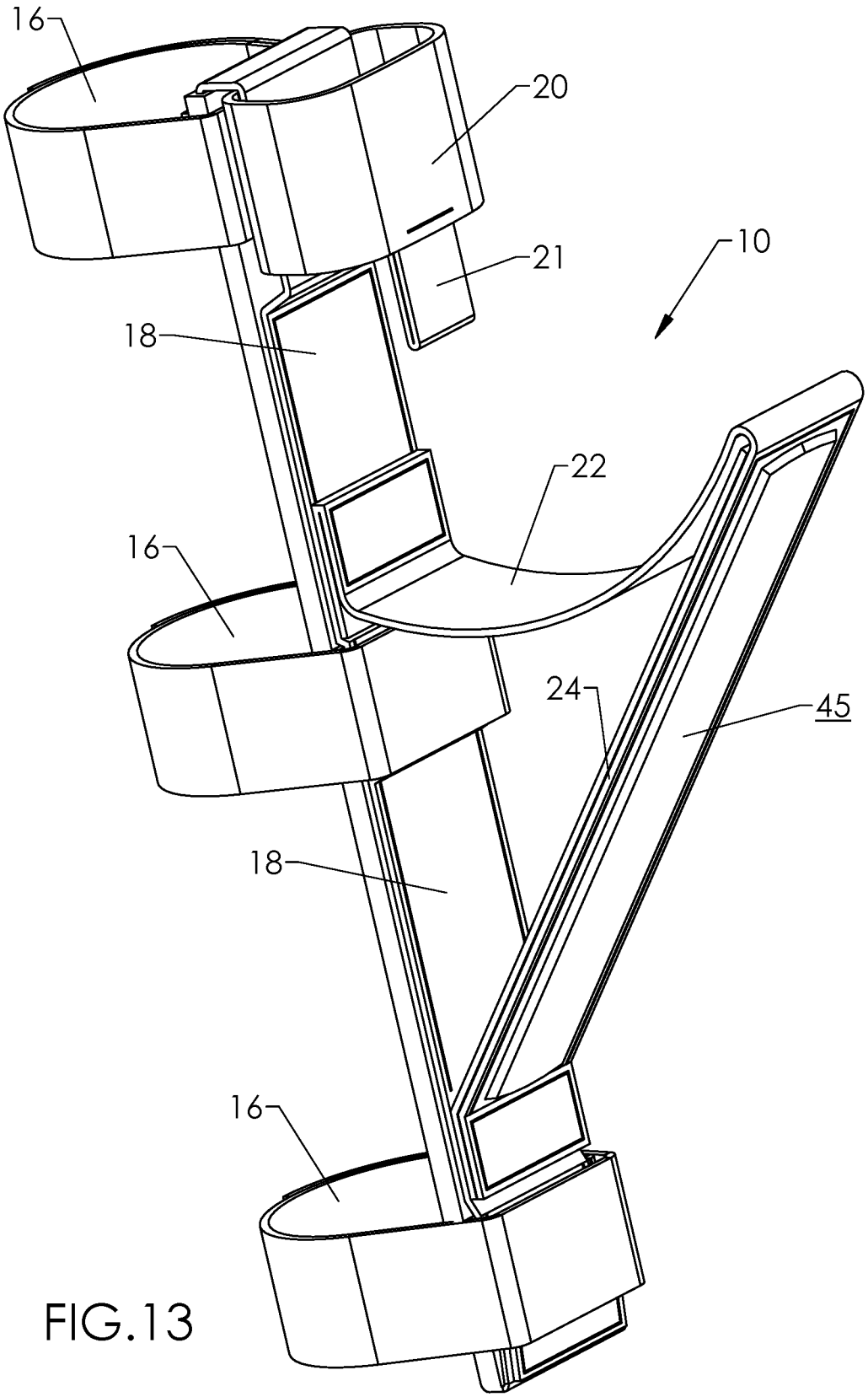
FIG. 13 is a rear right perspective view of the embodiment of FIGS. 1, and 6-9, with top, middle and bottom mounting straps fastened into loops as in FIG. 12.
Figure 14:
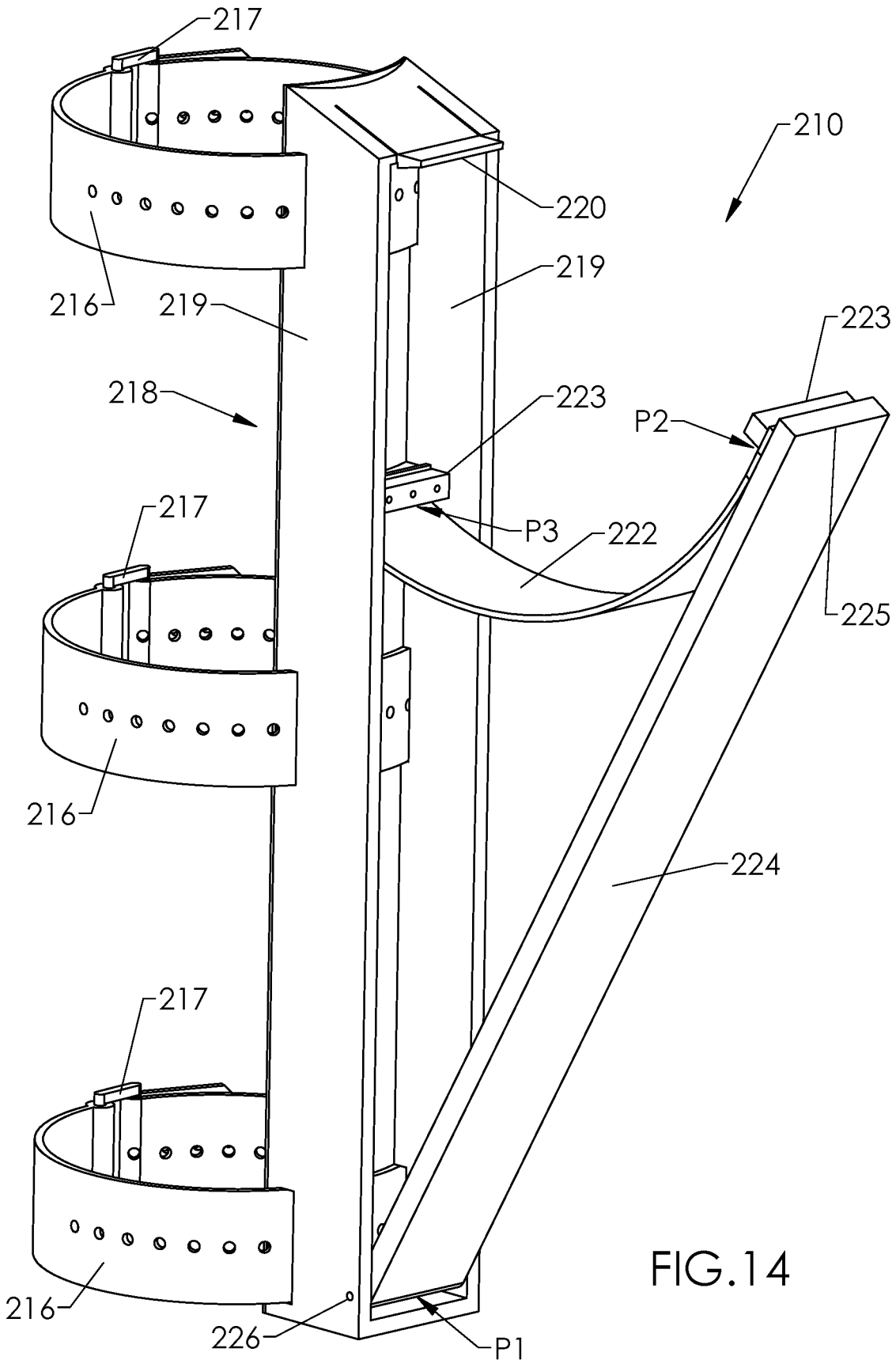
FIG. 14 is a rear right side perspective view of an alternative embodiment of the fold-out accessory rest depicted in FIG. 8, but that is mostly hard-goods, in a deployed position and with mounting straps fastened by buckling into loops.
Figure 15:
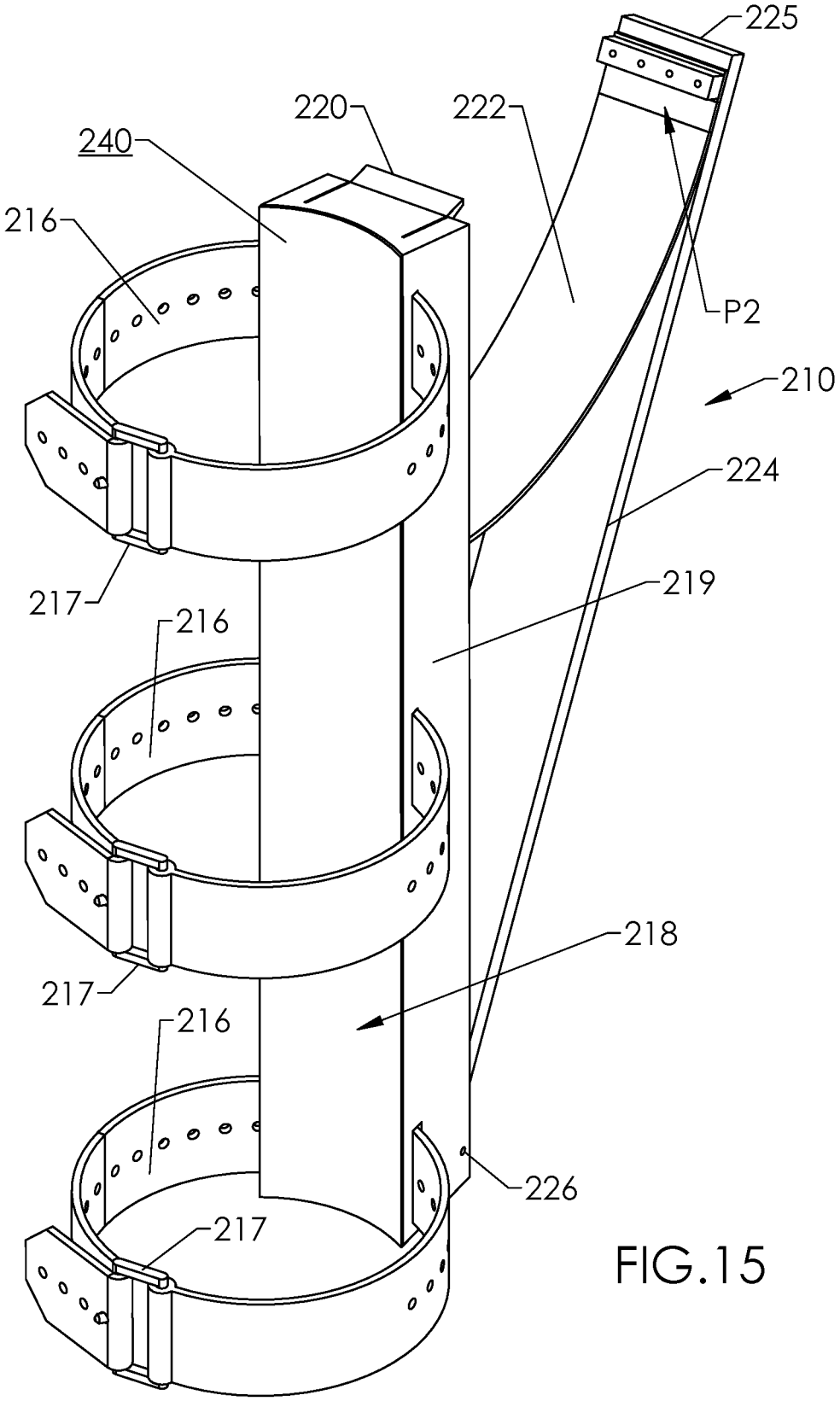
FIG. 15 is a top left rear perspective view of the embodiment of FIG. 14.
Figure 16:
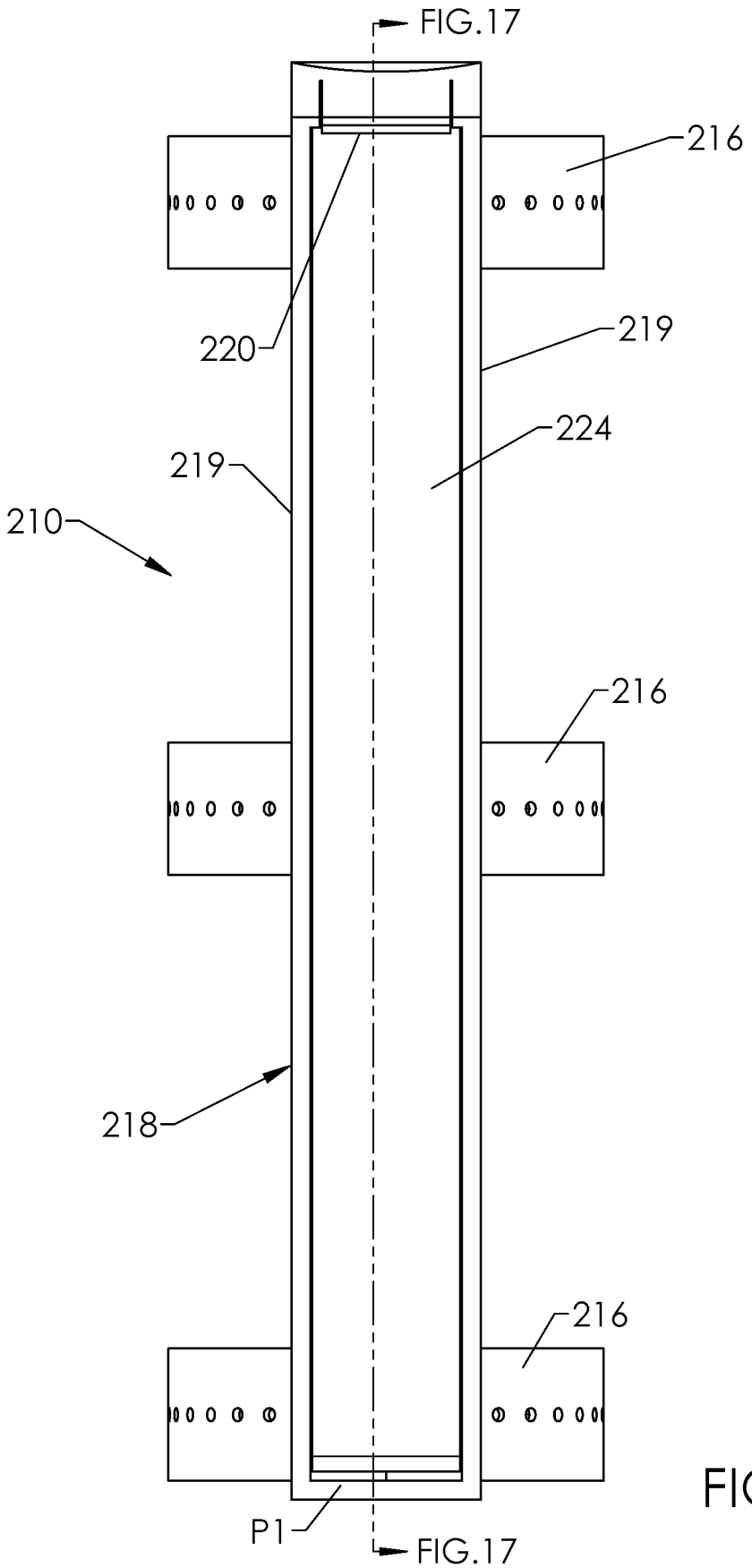
FIG. 16 is a front side view of the embodiment of FIG. 14 in the folded-up (undeployed) position.
Figure 17:
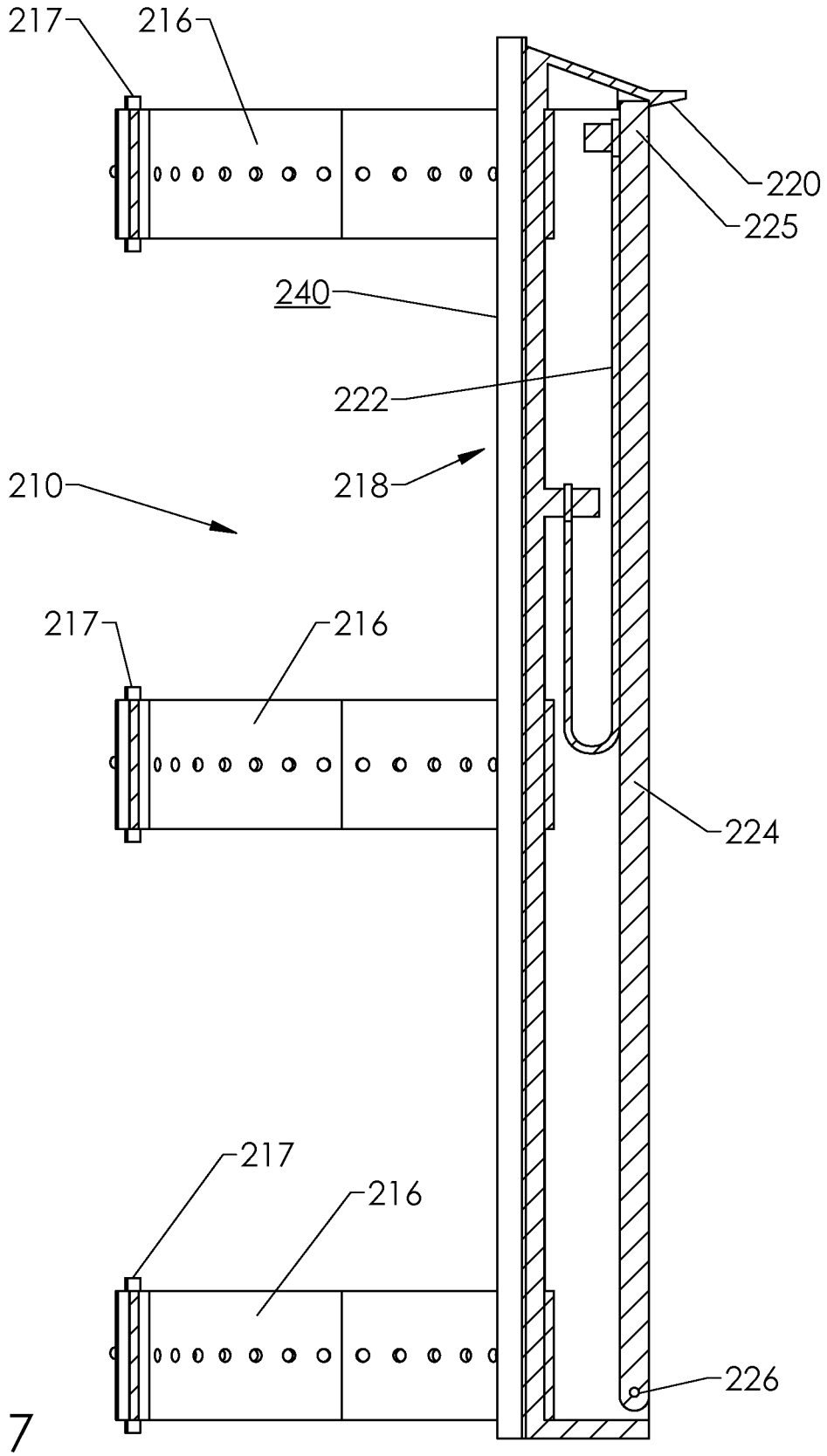
FIG. 17 is a cross-sectional view of the folded-up (undeployed) embodiment of FIG. 16 viewed along the line 17-17 in FIG. 16.

From FIGS. 10 and 11, in view of FIGS. 1-9, it will be understood that straps 16 are fixed, for example by sewing, to rest body 18, and that each strap 16 will extend from the rest-body 18, around the pole/leg 114, and then connect to itself by means of the hook-and-loop portions on each strap 16, to tightly hold the rest-body to the pole/leg 114. Also, it will be understood from FIGS. 10 and 11 that straps 16' are optional in certain circumstances on certain poles/legs, but that they may be added to enhance the securement system and reduce the chance of the rest 10' and the supported object being supported sliding down the pole/leg 114. This enhancement is done by wrapping straps 16' tightly around the rest-body 18 and the pole/leg 114 and securing the hook-and-loop portions of each strap 16'. FIGS. 12 and 13 show the rest 10 in deployed condition and with three straps 16 wrapped and fastened as if they were tightened around a pole/leg.

Depending on the flexibility and pivotability of the materials of the rest-strap 22 and supporting flap 24, and of their connections to each other, the supporting flap 24 may unfold (that is, swing outward from the rest body 18) to a greater or lesser extent when no weight is placed on the rest-strap 22. For example, with no weight on the rest-strap 22, as in FIGS. 12 and 13, the supporting flap 24 may unfold an amount in the range of about 50-90 percent of the full extent to which it could unfold before being stopped by the strap (for example, if pushed by a user or weighted by an accessory). However, once weight is placed on the strap, the rest-strap 22 and supporting flap 24 may adjust their positions, and the extent to which the supporting flap 24 swings outward from the rest body 18, depending on the weight and the width of the object being placed on the strap. Still, no matter the weight and the width of the object, as long as the width is less than the length of the rest-strap 22, the rest-strap 22 will tend to curve downward at generally it's middle and the supporting flap 24 will pivot accordingly. Thus, the term "deployed" includes various positions of the rest-strap 22 and supporting the flap 24, wherein the rest-strap 22 is in various concave positions, and the supporting flap's 24 length (longitudinal axis) is at various non-zero angles to the rest body 18, for example, in a range of 30-60 degrees and more typically about 45 degrees (40-50 degrees) to the length (longitudinal axis) of the rest body 18.

The materials of rests 10, 10' may be substantially fabric, for example nylon webbing, with additional fabric layers, stiffener(s), and/or gripping-texture materials to assist in handling, securement and operation of the rest 10, 10'. For example, it is preferred that rest body 18 has a gripping-texture fabric 40, such as SLIP-NOT™ material, as its inner surface to help prevent the rest 10, 10' from sliding down the pole/leg 14, 114. Also, the rest body 18 may comprise additional layers or moderate-stiffeners to make it firm for easy handling, but still to be slightly flexible so that the rest body 18 may conform, especially in its width direction and especially in response to tightening of the mounting straps 16, 16', to curve slightly to match the circumference of the pole/leg 14, 114. Also, the supporting flap 24 may comprise additional layers or stiffeners, such as the outer wall stiffener 45 of supporting flap 24 shown on the outer surface of the supporting flap 24 (see FIGS. 8 and 13) and/or the inner wall stiffener 46 of supporting flap 24 (see FIG. 12), which may be aluminum stays, for example, to keep the supporting flap 24 from bending or collapsing, especially in view of significant weight placed on the rest-strap 22, and hence transferred at least partially to the supporting flap 24, during use. Supporting flap 24 may further comprise additional or alternative stiffeners, for example, a stiffener provided between fabric layers of the supporting flap 24 instead of or in addition to the outer wall stiffener 45 and/or the inner wall stiffener 46. The straps 16, 16' are flexible so they may be wrapped around the pole/leg 14, 114 and optionally the rest body 18, but may feature some minor firmness/rigidity as is known for hook-and-loop straps.

Depicted in FIGS. 14-17 is a mostly non-fabric hard-goods embodiment rest 210. The rest body 218 in this embodiment is a rigid or substantially rigid body, with two sidewalls 219, and a rear wall 240 that is curved to preferably match or generally match the outer contour of pole/leg 14, 114 on which it is intended to be mounted. Two strap-attachments 223 are provided to attach one end of the rest-strap 222 to the rest body 218 and the other end to the juncture 225 of the rest-strap 22 and supporting flap 224 near the juncture 225 at their mutual distal ends 225. A plurality of mounting belts 216 are connected to the rest body 218 for tightly securing the rest body 218 to a pole/leg 14, 114 by means of a belt-fastening buckle 217 on each belt 216.

Hard-goods rest 210 operates much like rests 10 and 10', as the rest body 218 may be rigid or substantially rigid and is securely mounted to a rigid pole/leg 14, 114, and the supporting flap 224 is rigid and pivotally connected at P1 by axle 226 to allow the supporting flap 224 to pivot away from the rest body 218 for deployment of the hard-goods rest 210, and toward the rest body 218 for folding and storage of the rest 210. The supporting flap 224 is latched and unlatched to the rest body 218 by a spring catch 220 that snaps over the rest-strap 22/supporting flap 24 distal ends mutual juncture 225. Rest-strap 222, similarly to soft-goods rests 10 and 10' discussed above, is suspended between the supporting flap 224 and strap body 218 by means of attachments 223, and the flexible supporting strap 24 therefore flexes/pivots at pivot points P2 and P3.

In the mostly hard-goods embodiment of the subject fold-out rest 210, rest body 218 may be machined from metal (e.g. aluminum), molded and/or printed from plastics, or a combination thereof, or shaped and constructed from wood, etc. The rest-strap 222 is a flexible strap of, for example, nylon webbing. The belts 216 with buckles 217 may be plastic, or plastic with metal buckles, or leather, for example. The pieces/parts of hard-goods rest 210, i.e. 216, 218, 220, 222 and 224 correspond generally to the similarly numbered (but 200 numbers less) pieces/parts described above relating to FIGS. 1-13, as will be understood from the drawings and this description, and function of the pieces/parts for soft-goods rest 10, 10', to the extent possible and reasonable, may be applied to the function of the pieces/parts of hard-goods rest 210.

Certain embodiments may be described as a fold-out accessory rest for attachment on a pole, as in a trekking pole or ski pole, and/or for attachment on a leg, as in a tripod leg, comprising:

An elongate rest body with a long axis along its length, and with top, middle and lower parts to be installed on a pole or leg;

A securement means on the rest body for attaching and securing the rest body to a pole or leg;

A rest receiving and securing structure at or near a top part of the rest body for storing the rest body in a stowed folded-up (un-deployed) position;

A rest-strap adapted to be flexibly rotatably connected on its proximal end near the rest body's middle part;

A strap-supporting flap being adapted to be flexibly rotatably connected on its proximal end near the rest body's lower part;

The rest-strap also being adapted to be flexibly foldably connected on its distal end to the distal end of the strap-supporting flap to form a flexibly foldable juncture between the strap and flap;

Whereby the juncture between the rest-strap and the strap-supporting flap may be folded up so that both the strap and flap may be received and secured by the securement structure to place the rest-strap and the strap-supporting flap in the stowed folded-up (un-deployed) position, and whereby the strap and the flap may be conveniently and quickly un-secured from the securement structure to place the strap and flap in an outwardly unfolded (deployed) position.

In certain versions, the fold-out rest is constructed mostly from soft-goods, as in fabrics. In certain versions, the fold-out rest is constructed mostly from hard-goods, as in metal, molded or machined plastic, or wood except for possibly the rest-strap. In certain versions, the fold-out rest securement means is selected from the group consisting of: Straps of hook-and-loop material; Belts with buckles mostly of fabric, leather, plastic and/or rubber; Adhesives; Buttons and button-holes and mechanical catches, clips, latches or ties on the rest body; and Magnets and/or electrical or electronic latches or locks on the rest body.

Although this disclosed technology has been described above with reference to particular means, materials and embodiments, it is to be understood that the herein disclosed technology is not limited to these disclosed particulars, but extends instead to all equivalents within the broad scope of this disclosure, drawings, and following Claims.

The invention claimed is:

1. A fold-out accessory rest for attachment on a pole, as in a trekking pole or ski pole, and/or for attachment on a leg, as in a tripod leg, the fold-out accessory rest being for supporting a firearm, spotting scope, or camera lens and comprising:

a. An elongate rest body with a long axis along its length, and with top, middle and lower parts to be installed on a pole or leg;

b. A securement means on the rest body for attaching and securing the rest body to a pole or leg;

c. A receiving and securing structure at or near a top part of the rest body;

d. A flexible elongated rest-strap having a length between a proximal end and a distal end and adapted to be flexibly rotatably connected on its proximal end near the rest body's middle part;

e. A single strap-supporting flap having a flap proximal end and a flap distal end and being adapted to be flexibly rotatably connected on the flap proximal end near the rest body's lower part;

f. The rest-strap also being adapted to be flexibly foldably connected on its distal end to the flap distal end to form a flexibly foldable juncture between the rest-strap and the strap-supporting flap; and g. Whereby the juncture between the rest-strap and the strap-supporting flap may be folded up so that both the rest-strap and the strap-supporting flap may be received and secured by the receiving and securing structure to place the rest-strap and the strap-supporting flap in a stowed folded-up (un-deployed) position with the rest-strap folded along said length and lying between the rest body and the single strap-supporting flap, and whereby the rest-strap and the strap-supporting flap may be conveniently and quickly un-secured from the receiving and securing structure to place the rest-strap and the strap-supporting flap in an outwardly unfolded (deployed) position whereby the rest-strap flexes to cradle the firearm, spotting scope, or camera lens.

2. The fold-out accessory rest of claim 1 wherein the securement means is selected from the group consisting of:

a. Straps of hook-and-loop material;
b. Belts, with buckles, made of fabric, leather, plastic and/or rubber;
c. Adhesives;
d. Buttons and button-holes and mechanical catches, clips, latches or ties on the rest body; and
e. Magnets and/or electrical or electronic latches or locks on the rest body.

3. The fold-out accessory rest of claim 1, wherein said rest-strap is connected only to said rest body's middle part and said flap distal end.

4. The fold-out accessory rest of claim 3, wherein the rest-strap proximal end is lower than the rest-strap distal end in the undeployed and the deployed positions.

5. A fold-out accessory rest for attachment on a pole, such as a trekking pole or ski pole, or on a leg such as a tripod leg, the fold-put accessory rest being for supporting and stabilizing a front end of an elongated object such as a firearm, spotting scope, or camera lens that is also held by a user of the elongated object, the fold-out accessory rest consisting essentially of:

a. An elongate rest body with a long axis along its length, and with top, middle and lower parts to be installed on a pole or leg;
b. A securement means on the rest body for attaching and securing the rest body to a pole or leg;
c. A receiving and securing structure at or near a top part of the rest body;
d. A single flexible elongated rest-strap having a length between a proximal end and a distal end and adapted to be flexibly rotatably connected on its proximal end near the rest body's middle part;
e. A single strap-supporting flap having a flap proximal end and a flap distal end and being adapted to be flexibly rotatably connected on the flap proximal end near the rest body's lower part;
f. The rest-strap also being adapted to be flexibly foldably connected on its distal end to the flap distal end to form a flexibly foldable juncture between the rest-strap and the strap-supporting flap; and
g. Wherein the juncture between the rest-strap and the strap-supporting flap may be folded up so that both the rest-strap and the strap-supporting flap may be received and secured by the receiving and securing structure to place the rest-strap and the strap-supporting flap in a stowed folded-up (un-deployed) position with the rest-strap folded along said length of the rest-strap and lying between the rest body and the single strap-supporting flap, and wherein the rest-strap and the strap-supporting flap may be un-secured from the receiving and securing-structure to place the rest-strap and the strap-supporting flap in an outwardly unfolded (deployed) position wherein the rest-strap flexes to cradle the front end of the elongated object.

6. The fold-out accessory rest of claim 5 wherein the securement means is selected from the group consisting of:

a. Straps of hook-and-loop material;
b. Belts, with buckles, made of fabric, leather, plastic and/or rubber;
c. Adhesives;
d. Buttons and button-holes and mechanical catches, clips, latches or ties on the rest body; and
e. Magnets and/or electrical or electronic latches or locks on the rest body.

7. The fold-out accessory rest of claim 5, wherein said rest-strap is connected to said rest body's middle part and said flap distal end.

8. The fold-out accessory rest of claim 7, wherein the rest-strap proximal end is lower than the rest-strap distal end in the deployed and undeployed positions.

9. A combination of a firearm and a fold-out accessory rest supporting and stabilizing the firearm, the fold-out accessory rest being for attachment onto a pole or leg such as of a trekking pole, ski pole, or a tripod leg, and the fold-out accessory rest comprising:

a. An elongate rest body with a long axis along its length, and with top, middle and lower parts to be installed on a pole or leg;
b. A securement means on the rest body for attaching and securing the rest body to a trekking pole, ski pole, or tripod leg;
c. A receiving and securing structure at or near a top part of the rest body;
d. A flexible elongated rest-strap having a length between a proximal end and a distal end and adapted to be flexibly rotatably connected on its proximal end near the rest body's middle part;
e. A single strap-supporting flap having a flap proximal end and a flap distal end and being adapted to be flexibly rotatably connected on the flap proximal end near the rest body's lower part;
f. The rest-strap also being adapted to be flexibly foldably connected on its distal end to the flap distal end to form a flexibly foldable juncture between the rest-strap and the strap-supporting flap; and
g. Wherein the juncture between the rest-strap and the strap-supporting flap may be folded up so that both the rest-strap and the strap-supporting flap may be received and secured by the receiving and securing structure to place the rest-strap and the single strap-supporting flap in a stowed folded-up (un-deployed) position with the rest-strap folded along said length and lying between the rest body and the single strap-supporting flap, and wherein the rest-strap and the strap-supporting flap may be un-secured from the receiving and securing structure to place the rest-strap and the strap-supporting flap in an outwardly un-folded (deployed) position wherein the firearm rests on top of the rest-strap with the rest-strap flexed to cradle the firearm to stabilize the firearm during aiming and shooting.

10. The combination of claim 9, wherein the securement means is selected from the group consisting of:

a. Straps of hook-and-loop material;
b. Belts, with buckles, made of fabric, leather, plastic and/or rubber;
c. Adhesives;
d. Buttons and button-holes and mechanical catches, clips, latches or ties on the rest body; and
e. Magnets and/or electrical or electronic latches or locks on the rest body.

11. The combination of claim 9, wherein the rest-strap is connected to said rest body's middle part and said flap distal end.

12. The combination of claim 11, wherein the rest-strap proximal end is lower than the rest-strap distal end in the undeployed and deployed positions.

13. A fold-out accessory rest for attachment on a pole, such as a trekking pole or ski pole, or on a leg such as a tripod leg, the fold-put accessory rest being for supporting and stabilizing a front end of an elongated object such as a firearm, spotting scope, or camera lens that is also held by a user of the elongated object, the fold-out accessory rest consisting of:

An elongate rest body;

Securement means on the rest body for installing the rest body on a pole or leg;

A single strap-supporting flap having a lower end flexibly connected to a lower part of the rest body so that the strap-supporting flap is pivotable toward the rest body into a folded-up undeployed position and is pivotable outward from the rest body into an unfolded deployed position; and A single flexible elongated rest-strap being connected only to the rest body and the single strap-supporting flap, the rest-strap having a length between a strap proximal end and a strap distal end, wherein the strap proximal end is flexibly connected to the rest body and the strap distal end is flexibly connected to the strap-supporting flap;

Wherein, in the folded-up undeployed position, a receiving and a structure on the rest body secures the strap-supporting flap to the rest body with the rest-strap folded between the rest body and the strap-supporting flap, and, in the unfolded deployed position, the strap-supporting flap is unsecured from said structure and pivoted away from the rest body so that the rest-strap is suspended between the rest body and the strap-supporting flap, wherein the rest-strap cradles the front end of the elongated object between the body and the flap.

14. The fold-out accessory rest of claim 13 wherein the securement means is selected from the group consisting of:

a. Straps of hook-and-loop material;

b. Belts, with buckles, made of fabric, leather, plastic and/or rubber;

c. Adhesives;

d. Buttons and button-holes and mechanical catches, clips, latches or ties on the rest body; and e. Magnets and/or electrical or electronic latches or locks on the rest body.

15. The fold-out accessory rest of claim 13, wherein said rest-strap is connected to said rest body's middle part and an upper end of the strap-supporting flap.

16. The fold-out accessory rest of claim 13, wherein the rest-strap proximal end is lower than the rest-strap distal end in the undeployed and the deployed positions.

* * * * *